US007128017B2

(12) United States Patent
Guarino et al.

(10) Patent No.: US 7,128,017 B2
(45) Date of Patent: Oct. 31, 2006

(54) CORROSION RESISTANT CONNECTION SYSTEM

(75) Inventors: John R. Guarino, Rehoboth, MA (US); Robert M. Olson, Riverside, RI (US); Robert C. Earl, Tiverton, RI (US)

(73) Assignee: Raytheon Company, Waltham, MA (US)

( * ) Notice: Subject to any disclaimer, the term of this patent is extended or adjusted under 35 U.S.C. 154(b) by 362 days.

(21) Appl. No.: 10/860,337

(22) Filed: Jun. 3, 2004

(65) Prior Publication Data

US 2005/0269120 A1 Dec. 8, 2005

(51) Int. Cl.
*B63G 8/00* (2006.01)

(52) U.S. Cl. ..... 114/312; 439/92

(58) Field of Classification Search ..... 114/242, 114/244, 245, 247, 249, 253, 312; 367/20, 367/119; 403/187, 270, 271; 439/92, 99, 439/100

See application file for complete search history.

(56) References Cited

U.S. PATENT DOCUMENTS 3,159,806 A * 12/1964 Piasecki ..... 114/245
3,787,795 A * 1/1974 Thompson et al. ..... 439/99
4,873,763 A * 10/1989 Volonta et al. ..... 439/82
5,442,133 A * 8/1995 Arnold et al. ..... 439/92
6,065,418 A * 5/2000 Goldstein et al. ..... 114/312
6,089,930 A * 7/2000 Matsuoka et al. ..... 439/886

* cited by examiner

*Primary Examiner*—Lars A. Olson
(74) *Attorney, Agent, or Firm*—Iandiorio & Teska

(57) ABSTRACT

A corrosion resistant connection system including a base structure, a threaded orifice in the base structure, a seal about the threaded orifice and a threaded stud with a distal end, a proximal end, and an intermediate shoulder defining a sealing surface opposing a support surface. The distal end of the threaded stud is received in the orifice of the base structure driving the sealing surface of the shoulder to engage the seal to prevent corrosion of the threaded orifice, while maintaining electrical continuity. A terminal is disposed about the proximal end of the threaded stud seated on the support surface of the shoulder. A threaded nut is disposed about the proximal end of the stud engaging the terminal.

47 Claims, 5 Drawing Sheets

CORROSION RESISTANT CONNECTION SYSTEM

FIELD OF THE INVENTION

This invention relates to a corrosion resistant connection system useful for helicopter deployed underwater electronic equipment as well as other underwater equipment, devices, vehicles, and structures.

BACKGROUND OF THE INVENTION

Helicopter deployed underwater electronic equipment such as mine sweepers as well as other sensors and devices such as unmanned undersea vehicles, torpedoes, and submarines are subject to corrosion. In the case of helicopter deployed equipment, the motion of the rotor blades through the air results in the accumulation of electrostatic charges on the helicopter (sometimes 100 kV or more) which would be discharged from the helicopter to the water, through the tether between the helicopter and the towed equipment damaging the internal electronic subsystems of the towed equipment. Typically, to prevent this electrostatic discharge damage, a ground wire is run from the helicopter to a terminal connected to the hull of the towed equipment via a fastener. Surface corrosion protection treatments cannot be used at the threaded interface between the fastener and the hull of the towed equipment due to the need for a good electrical connection. Thus, the threaded hole in the towed equipment hull in which the fastener is installed is subject to general corrosion, crevice corrosion, and galvanic corrosion.

The result is that after deployment and retrieval of the towed equipment, personnel must inspect and if necessary clean and refurbish the connection between the ground wire terminal, the fastener and the hull of the towed equipment. Typically, the fastener and terminal are removed from the hull of the towed equipment breaking the ground connection. In any case, the inspection, cleaning, and refurbishment effort can be costly and time consuming.

There are also other scenarios where a fastener is threaded into the hull of an underwater deployed sensor or device and subject to corrosion. One example is cathodic protection terminals wherein a zinc slug is connected to a fastener threaded into the hull of a torpedo or submarine. Again, the threaded interface between the hull of the torpedo or submarine and the fastener is subject to corrosion.

SUMMARY OF THE INVENTION

It is therefore an object of this invention to provide a corrosion resistant connection system.

It is a further object of this invention to provide such a system which reduces the need to clean and refurbish the connection saving time and money.

It is a further object of this invention to provide such a system which can be used both in connection with helicopter ground terminals and cathodic protection terminals.

It is a further object of this invention to provide such a system which is simple in design, inexpensive to manufacture, and easy to install.

It is a further object of this invention to provide such a system which maintains electrical continuity and at the same time reduces or eliminates corrosion.

It is a further object of this invention to provide such a system which allows the terminal to be removed from the base structure without affecting the seal about the threaded orifice in the base structure.

The subject invention, however, in other embodiments, need not achieve all these objectives and the claims hereof should not be limited to structures or methods capable of achieving these objectives. The subject invention results from the realization that a better corrosion resistant electrical connection between a terminal and the hull of an underwater deployed device is effected by a special shouldered fastener for the terminal combined with a seal between the fastener and the unprotected threaded hole in the hull of the device.

This invention features, in one example, a corrosion resistant connection system comprising a base structure, a threaded orifice in the base structure, a seal about the threaded orifice, and a threaded stud including a distal end, a proximal end, and an intermediate shoulder defining a sealing surface opposing a support surface. The distal end of the threaded stud is received in the orifice of the base structure driving the sealing surface of the shoulder to engage the seal to prevent corrosion of the threaded orifice. A terminal is disposed about the proximal end of the threaded stud seated on the support surface of the shoulder and a threaded nut is disposed about the proximal end of the stud engaging the terminal.

Typically, a threaded insert is disposed in the orifice receiving the distal end of the threaded stud. In one example, the threaded insert is made of stainless steel. A protective surface treatment may be included on the base structure about the threaded orifice. In one embodiment, a channel in the base structure about the threaded orifice receives the seal therein. In another embodiment, a channel in the sealing surface of the intermediate shoulder receives the seal therein.

The base structure may be the hull of an undersea device such as an unmanned undersea vehicle, a mine sweeper, a mine neutralization device, a sonar device, a mine hunter, a torpedo, a submarine, or an undersea structure.

In one embodiment, the terminal is a helicopter ground attachment includes a washer about the proximal end of the stud seated on the support surface of the shoulder and a conductor extending from the washer. In another embodiment, the terminal is an sacrificial anode such as a zinc slug about the proximal end of the stud and seated on the support surface of the shoulder. One possible seal is an elastomeric O-ring made of rubber. In one example, the threaded stud is made of stainless steel and the distal and proximal ends of the threaded stud and the shoulder are integral. The threaded nut may also be made of stainless steel.

In one preferred embodiment, the support surface of the intermediate shoulder includes a peripheral step down portion and the periphery of the intermediate shoulder includes opposing flats engageable with a wrench.

In one embodiment, the corrosion resistant connection system of this invention features a helicopter towed device, a threaded orifice in the hull of the helicopter towed device, a seal about the threaded orifice, a threaded stud including a distal end, a proximal end, and an intermediate shoulder defining a sealing surface opposing a support surface, the distal end of the threaded stud threaded into the orifice of the hull driving the sealing surface of the shoulder to engage the seal to prevent corrosion of the threaded orifice, a helicopter ground attachment including a washer about the proximal end of the stud and seated on the support surface of the shoulder and a conductor extending from the washer, and a threaded nut about the proximal end of the stud engaging the washer.

In another embodiment, the corrosion resistant connection system of the subject invention features an underwater hull structure, a threaded orifice in the hull structure, a seal about the threaded orifice, a threaded stud including a distal end, a proximal end, and an intermediate shoulder defining a sealing surface opposing a support surface, the distal end of the threaded stud threaded into the orifice of the hull driving the sealing surface of the shoulder to engage the seal to prevent corrosion of the threaded orifice, a cathodic anode about the proximal end of the threaded stud seated on the support surface of the shoulder, and a threaded nut about the proximal end of the stud engaging the anode.

This invention also features a corrosion resistant connection system with a seal, and a stud including a distal end, a proximal end, and an intermediate shoulder defining a sealing surface opposing a support surface. The distal end of the stud is configured to be received in a base structure driving the sealing surface of the shoulder to engage the seal and the base structure. A terminal is seated on the support surface of the shoulder and a fastener engaging the terminal. Typically, the distal and proximal ends of the stud are threaded, the terminal is disposed about the proximal end of the stud, and the fastener is disposed about the proximal end of the stud.

This invention also features a corrosion resistant connection system with a base structure, and a fastener including a shoulder defining a sealing surface opposing a support surface, a proximal stud extending from the support surface, and a distal stud extending from the sealing surface. A seal is disposed between the sealing surface of the fastener shoulder and the base structure and a terminal is disposed about the proximal stud and on the support surface of the fastener and removable from the fastener without disturbing the seal between the sealing surface of the fastener shoulder and the base structure.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
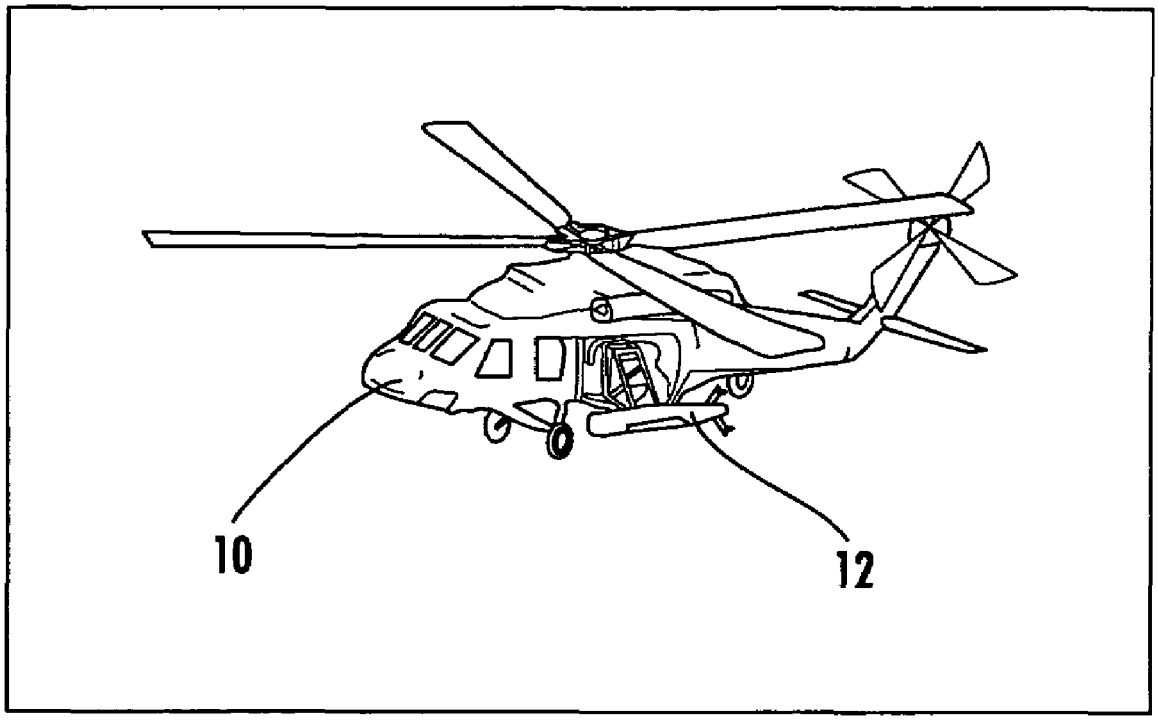
FIGS. 1–2 are schematic views showing the deployment of a mine sweeper from a helicopter.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
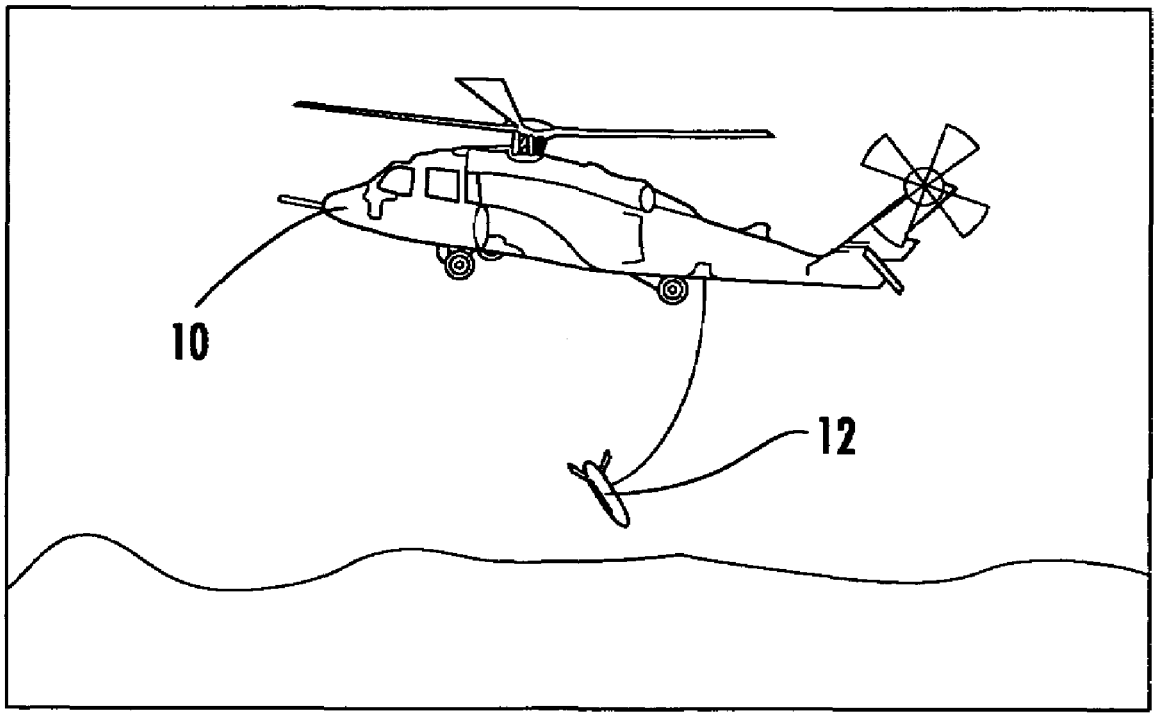

As discussed in the Background section above, undersea sensors deployed from helicopter platforms require special provisions for electrical grounding. During flight, electrostatic charges accumulate on helicopter 10, FIGS. 1–2 due to the motion of the rotor blades through the air. The accumulated charge can be as large as hundreds of thousands of volts. As a sensor such as mine sweeper 12 is deployed into the seawater, the electrostatic charge would be discharged through the sensor. As such, a continuous electrical discharge path from the sensor back to the helicopter is required to allow for safe electrostatic discharge without damaging the sensor or the helicopter.

Figure 3:
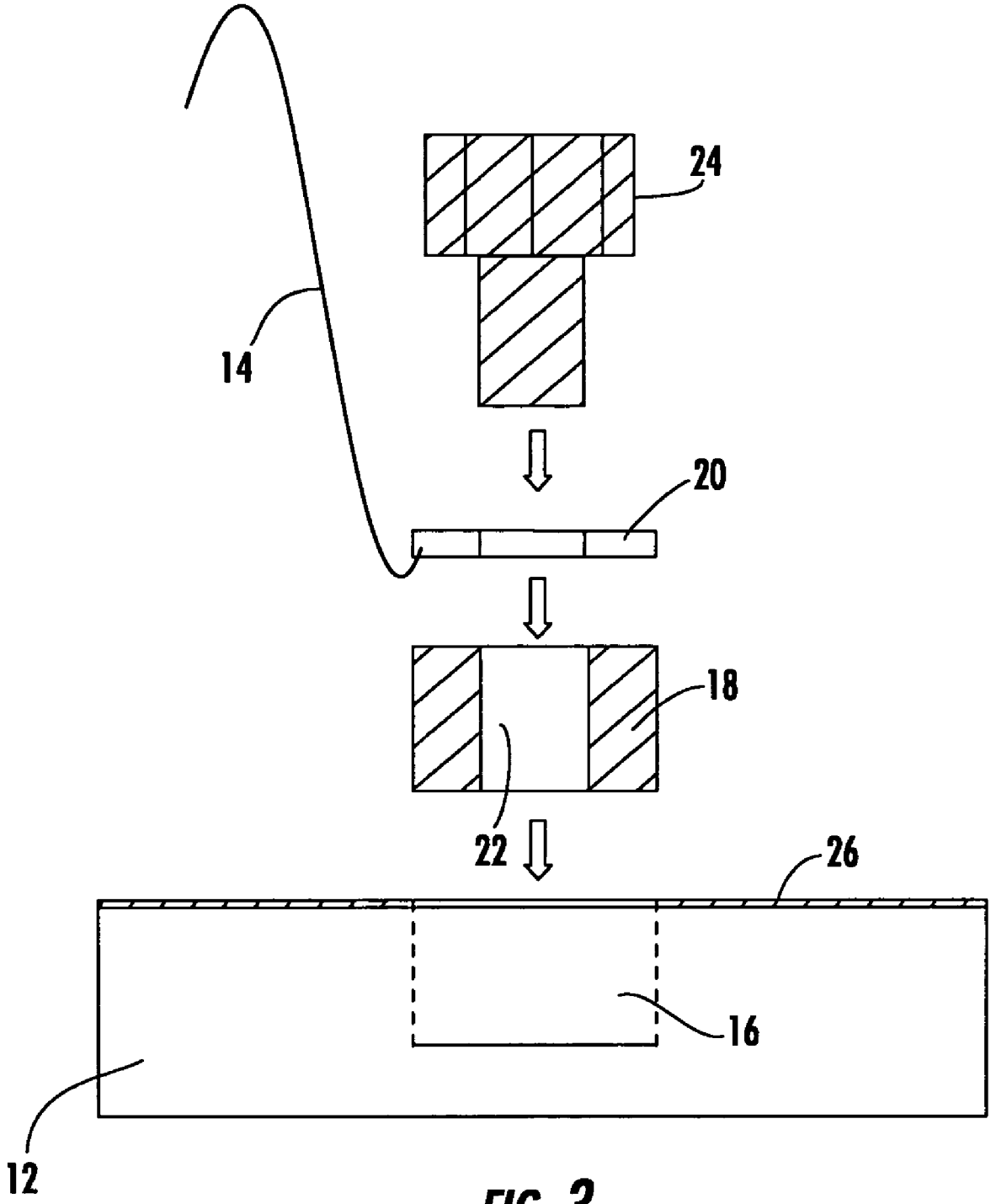
FIG. 3 (PRIOR ART)
FIG. 3 is an exploded cross sectional view of a typical prior art grounding technique for the mine sweeper shown in FIGS. 1–2.

Typically, the continuous discharge path between the sensor and the helicopter is obtained by electrically connecting the sensor to a ground strap on the helicopter using a mechanical connection such as low gauge ground wire 14, FIG. 3. Ground wire 14 usually mechanically and electrically interfaces the sensor hull via a lug type connection which is secured to the sensor with a metallic screw. Because a metal-to-metal contact between the screw and the sensor is required in order to maintain electrical connectivity, the tapped hole 16 in the sensor must have bare exposed threads. Exposure of the bare threads to seawater creates an opportunity for corrosion and oxidation on the sensor which can reduce the overall life of the sensor. In summary, a continuous, low impedance discharge path through the sensor must be provided to protect the internal electronics from electrostatic discharge but this electrical continuity is achieved at the expense of corrosion performance.

In one prior art example, threaded orifice 16 is tapped in hull or base structure 12 of the sensor equipment to be deployed under water and towed by a helicopter. Threaded insert 18 is threaded into orifice 16 and includes threaded channel 22, typically stainless steel. Terminal 20 is in the form of a washer-like ground attachment typically made of stainless steel. Ground wire 14 extends from ground attachment 20. Threaded fastener 24 also typically made of stainless steel is received through ground attachment 20 and is threaded into insert 18. A protective surface treatment 26 such as anodizing or an insulative paint may be applied on the surface of hull 12 (typically an aluminum alloy) proximate threaded orifice 16.

Figure 4:
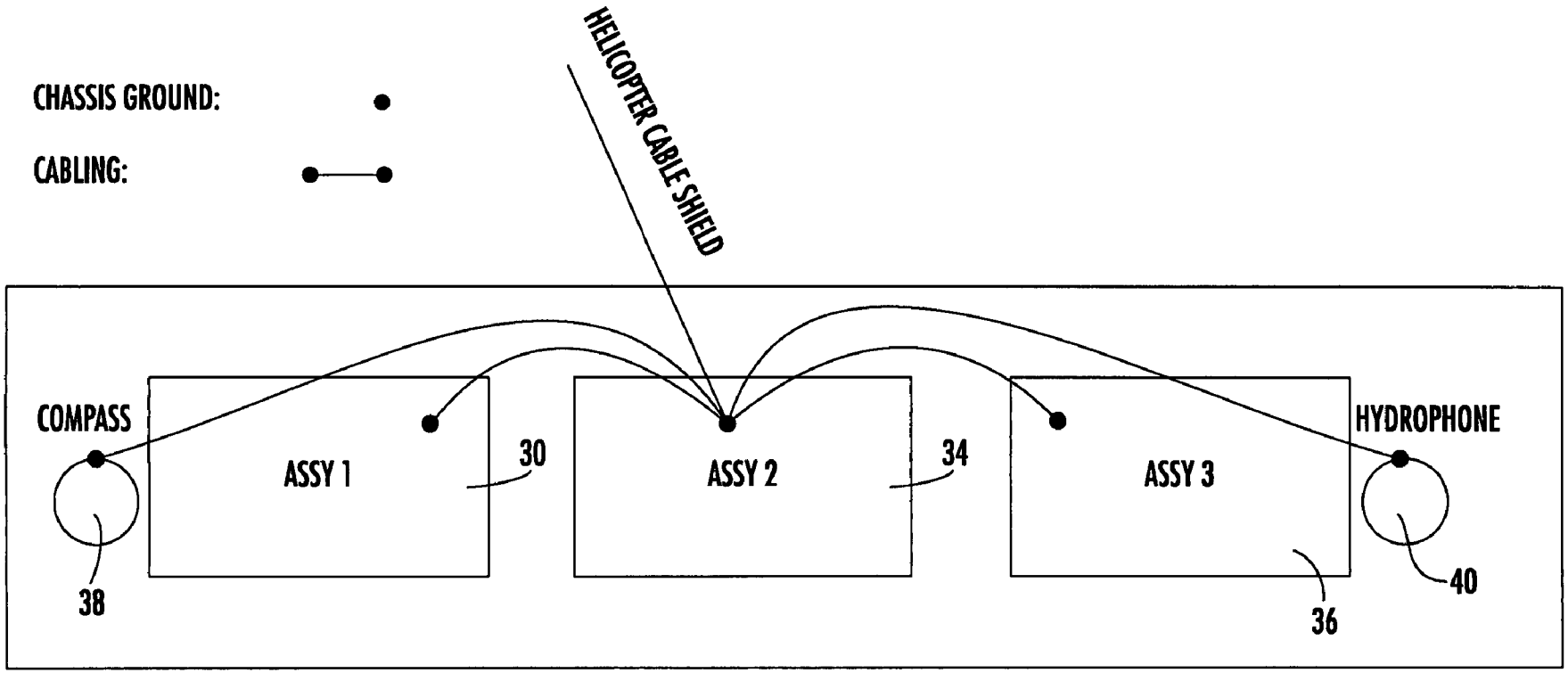
FIG. 4 is a block diagram showing the grounding scenario for a typical helicopter deployed undersea sensor system.

The surface treatment, however, cannot be used at the threaded interface between orifice 16 and insert 18 or between insert 18 and fastener 24 due to the requirement of electrical continuity between terminal 20 and hull 12. As such, orifice 16 in hull 12 is exposed to seawater creating a corrosive weak link. General corrosion, crevice corrosion, and/or galvanic corrosion often results and personnel must inspect and refurbish if necessary the connection after each deployment of hull 12 resulting in a great expense especially given that the typical sensor may have multiple, isolated assemblies each of which is tied back to the helicopter ground as shown in FIG. 4 where blocks 30 and 36 represent different assemblies connected to assembly 34 as well as compass 38 and hydrophone 40 also connected to assembly 34.

Figure 5:
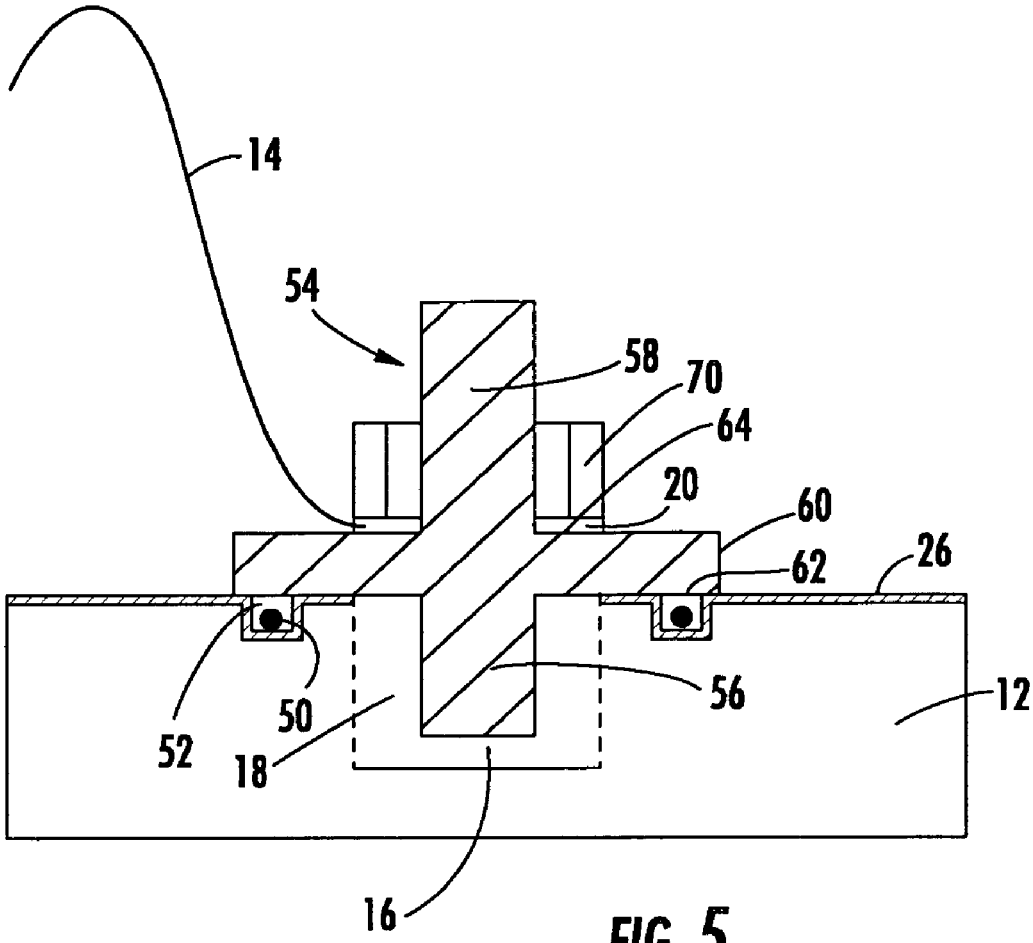
FIG. 5 is a cross sectional view showing one embodiment of the corrosion resistant connection system of the subject invention useful for a ground attachment.

In the subject invention, orifice 16, FIG. 5 is threaded in the base structure which may be the hull of a helicopter deployed undersea sensor device such as an unmanned undersea vehicle, mine sweeping equipment, mine neutralization equipment, or sonar equipment. Stainless steel threaded insert 18 which is threaded on the inside diameter and also on the outside diameter is typically threaded into orifice 16 as shown. Seal 50 which in one example is a elastomeric (e.g., rubber) O-ring is disposed about orifice 16 in channel 52. Threaded stud fastener 54 includes distal end 56 and proximal end 58 both of which are typically threaded. Intermediate shoulder 60 defines sealing surface 62 opposing support surface 64. Threaded stud 54, in one example, is made of stainless steel and formed to be an integral (one-piece) construction.

During installation, the area of the hull surface about threaded orifice 16 is treated with a protective coating 26 in the form of anodizing and/or electrically insulative paint. The surface treatment may extend to the periphery of threaded insert 18. The surface treatment is also applied to channel 52. O-ring 50 is installed in channel 52 and distal end 56 of stud 54 is threaded into threaded insert 18 driving sealing surface 62 of shoulder 60 to engage O-ring seal 50. In this way, sea water cannot enter the area of threaded unprotected orifice 16 in hull 16 to reduce or eliminate corrosion at the threaded interface between insert 18 and orifice 16 and also at the threaded interface between insert 18 and the distal end 56 of stud 54.

Next, terminal 20 is disposed over the proximal end 58 of stud 54 and seated on support surface 64 of shoulder 60. Threaded nut 70 (preferably made of stainless steel) is threaded onto the proximal end 58 of stud 54 to engage terminal 20.

Note that in other embodiments, distal end 56 of stud 54 may be threaded directly into orifice 16 eliminating the need for threaded insert 18. And, other fastener means other than threaded interconnections may be used for securing stud 54 with respect to hull 12 and other fastener means other than nut 70 may be used to secure terminal 20 on support surface 64 of shoulder 60. In the specific embodiment shown, terminal 20 is a helicopter ground attachment with conductor 14 extending from washer shaped terminal 20. Electrical connectivity is maintained from conductor 14, through washer 20 and stud 54, and to hull 12 via threaded insert 18 but the sealing interface between O-ring 50 and sealing surface 62 of shoulder 60 combined with surface treatment 26 helps prevent corrosion. And, note that terminal 20 can be removed from stud 54 without breaking the seal between sealing surface 62 of shoulder 60 and the surface of hull 12.

Figure 6:
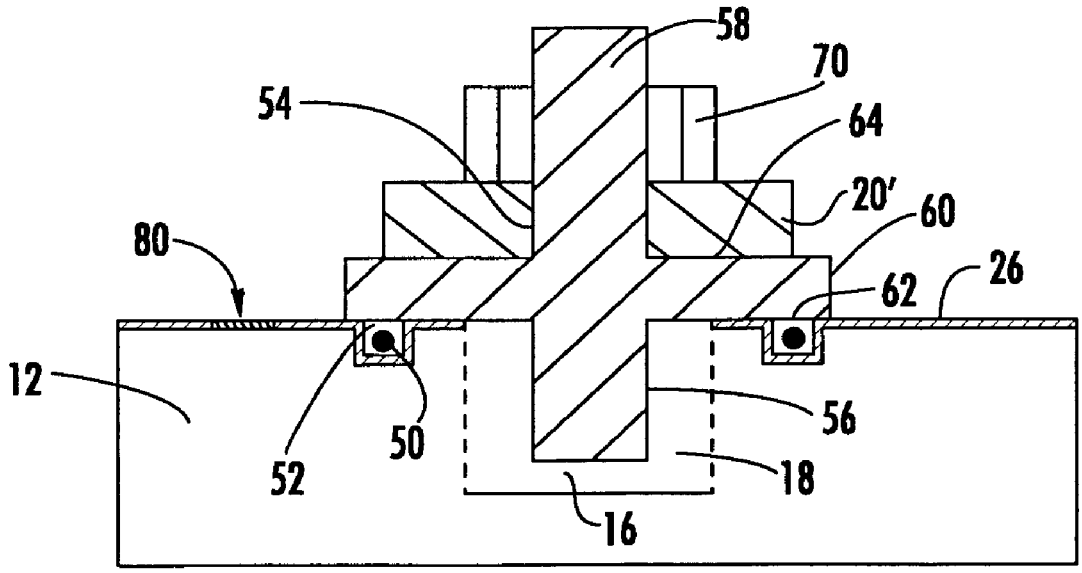
FIG. 6 is a schematic cross sectional view showing another embodiment of a corrosion resistant connection system in accordance with the subject invention useful for cathodic protection.

In the embodiment of FIG. 6, terminal 20' is a cast zinc sacrificial anode seated on support surface 64 of shoulder 60 for cathodic protection of underwater devices and structures including the helicopter towed devices discussed above but also unmanned undersea vehicles, mine hunting equipment, torpedoes, submarines, and other under sea structures. When damage to surface treatment 26 occurs as shown at 80, cathode protection of the base material of hull 12 is required and anode 20' must be electrically connected to hull 12 in the same way helicopter ground attachment 20, FIG. 5 is electrically connected to the hull. Electrical connectivity is maintained from anode 20' through stud 54 and to hull 12 via threaded insert 18 but again the sealing interface between O-ring 50 and sealing surface 62 of shoulder 60 combined with surface treatment 26 helps prevent corrosion. Zinc anode 20' can be removed from stud 54 without breaking the seal between sealing surface 62 of shoulder 60 and the surface of hull 12. A new anode can then be installed as necessary.

Figure 7:
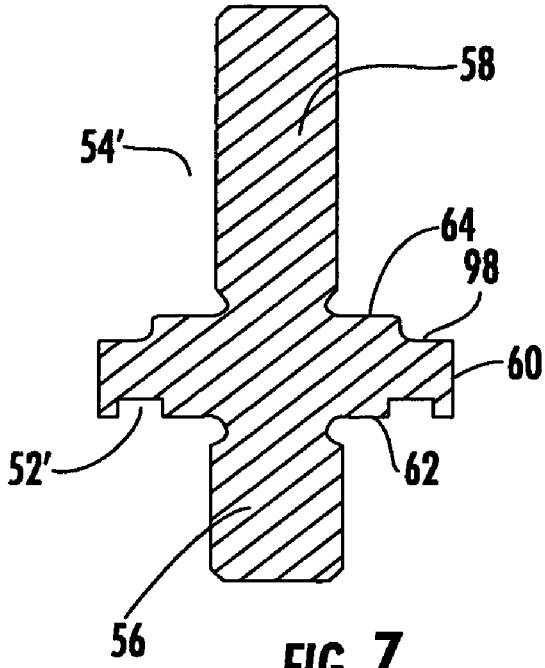
FIG. 7 is a cross sectional view of one preferred embodiment of the threaded stud component of the corrosion resistant connection system of the subject invention.
Figure 8:
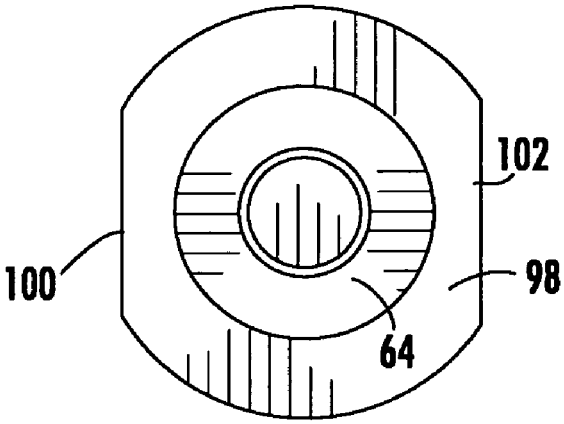
FIG. 8 is a plan view of the threaded stud shown in FIG. 7.
Figure 9:
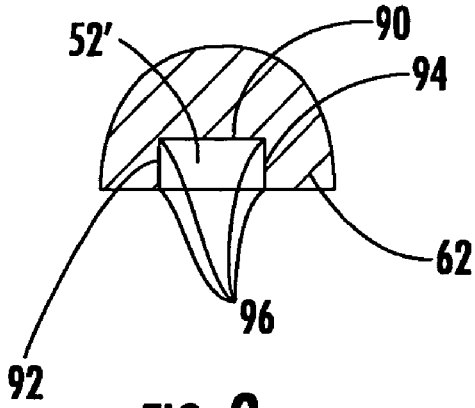
FIG. 9 is a detailed cross sectional view of the O-ring channel in the sealing surface of the stud shown in FIG. 7.

FIGS. 7–9 show one preferred embodiment for stud 54'. Typically, distal end 56 and proximal end 58 are threaded as discussed above with reference to FIGS. 5–6. Instead of forming channel 52, FIG. 5 in the surface of hull 12 for O-ring 50, however, channel 52', FIG. 7 is formed in sealing surface 62 of shoulder 60 to receive the O-ring seal. In one example, the top 90, FIG. 9 of channel 52' is 0.101" long, walls 92 and 94 taper outwards at an angle of between 0°–5°, and corners 96 have a radius of between 0.005–0.015". Support surface 64, FIG. 8 of shoulder 60 has a peripheral step down portion 98 and the round periphery of intermediate shoulder 60 includes opposing flats 100 and 102 engageable with a wrench for driving the stud into the threaded insert in the hull of the sensor or other structure. In this particular example, distal end 56 of stud 54' is 0.40" long, proximal end 58 is 0.75" long, shoulder 60 is 0.25" thick at support surface 64 and 0.19" thick at peripheral step down portion 98. Shoulder 60 is 1.0" in diameter and flats 100 and 102 are spaced 0.875" apart.

The corrosion resistant connection system of this invention thus reduces the need to clean and refurbish the connection saving time and money. The versatile system of this invention can be used both in connection with helicopter ground terminals, cathodic protection terminals, and possibly other terminal connections. The system is simple in design, inexpensive to manufacture, and easy to install. Electrical continuity is maintained and at the same time corrosion is reduced or eliminated. The terminal can be removed from the base structure without affecting the seal about the threaded orifice in the base structure.

The connection system of the subject invention maintains electrical connectivity but does not require exposing the hull or base material to seawater resulting in a much improved design from a corrosion stand point. Tapped hole 16, FIGS. 5–6 in hull 12 serves as the grounding point. Typically, the threads in the tapped hole are bare and do not have a protective surface treatment to ensure metal-to-metal contact at the ground point. Optional insert 18 is installed in the tapped hole and serves as a receptacle for shouldered fastener 54. The shouldered fastener is typically threaded on both ends 56 and 58. Proximal end 58 receives the mounting lug from the helicopter ground strap 14 and distal end 56 is threaded for screwing the shouldered fastener into insert 18. As the threads in the tapped hole are exposed, metal-to-metal contact is readily achieved between insert 18 and hull 26 and the shouldered ground stud 54 and insert 18. Metallic threaded nut 70 secures ground lug 20 FIG. 5 or zinc anode terminal 20' FIG. 6 to shouldered fastener 54. O-ring 50 is used to form a seal between shouldered fastener 54 and hull surface 26. The O-ring groove can be located in the surface of the hull as shown in FIGS. 5–6 or on the shouldered fastener as shown in FIG. 7. By using an O-ring or a similar structure to seal between the shouldered fastener and the hull surface, water is precluded from contacting the exposed metallic threads in the tapped hole in the hull structure. Thus, electrical continuity is maintained as well as resistance to corrosion. All of the items that are exposed to water are preferably fabricated from corrosion resistant materials (i.e., high alloy stainless steels), or incorporated the appropriate surface treatments which protect the base material against corrosion. By isolating the susceptible materials from water, the inventive grounding scheme provides low electrical resistance without sacrificing performance from a corrosion standpoint. The use of the connection system of the subject invention is applicable to many under sea devices where the electrical connections are exposed to water and reduces maintenance of the devices in the field to lower the cost. Depot level maintenance need not remove and repair the grounding connections on a periodic schedule as was the case with the prior art shown in FIG. 3.

Although specific features of the invention are shown in some drawings and not in others, however, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims. For example, the connection of the subject device may have uses any time a body is subjected to corrosion be if corrosive liquids, gasses, or solids.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A corrosion resistant connection system comprising:
- a base structure;
- a threaded orifice in the base structure;
- a seal about the threaded orifice;
- a threaded stud including a distal end, a proximal end, and an intermediate shoulder defining a sealing surface opposing a support surface, the distal end of the threaded stud received in the orifice of the base structure driving the sealing surface of the shoulder to engage the seal to prevent corrosion of the threaded orifice;
- a terminal about the proximal end of the threaded stud seated on the support surface of the shoulder; and
- a threaded nut about the proximal end of the stud engaging the terminal.

2. The system of claim 1 further including a threaded insert in the orifice receiving the distal end of the threaded stud.

3. The system of claim 2 in which the threaded insert is made of stainless steel.

4. The system of claim 1 further including a protective surface treatment on the base structure about the threaded orifice.

5. The system of claim 1 further including a channel in the base structure about the threaded orifice receiving the seal therein.

6. The system of claim 1 further including a channel in the sealing surface of the intermediate shoulder receiving the seal therein.

7. The system of claim 1 in which the base structure is the hull of an undersea device.

8. The system of claim 7 in which the undersea device is selected from the group consisting of unmanned undersea vehicles, mine sweeping equipment, mine neutralization equipment, a sonar device, mine hunting equipment, torpedoes, submarines, and undersea structures.

9. The system of claim 1 in which the terminal is a helicopter ground attachment including a washer about the proximal end of the stud seated on the support surface of the shoulder and a conductor extending from the washer.

10. The system of claim 1 in which the terminal is an anode.

11. The system of claim 10 in which the anode is a zinc slug about the proximal end of the stud and seated on the support surface of the shoulder.

12. The system of claim 1 in which the seal is an elastomeric O-ring.

13. The system of claim 12 in which the O-ring is made of rubber.

14. The system of claim 1 in which the threaded stud is made of stainless steel.

15. The system of claim 1 in which the distal and proximal ends of the threaded stud and the shoulder are integral.

16. The system of claim 1 in which the threaded nut is made of stainless steel.

17. The system of claim 1 in which the support surface of the intermediate shoulder includes a peripheral step down portion.

18. The system of claim 1 in which the periphery of the intermediate shoulder includes opposing flats engageable with a wrench.

19. A corrosion resistant connection system comprising:
- a helicopter towed device;
- a threaded orifice in the hull of the helicopter towed device;
- a seal about the threaded orifice;
- a threaded stud including a distal end, a proximal end, and an intermediate shoulder defining a sealing surface opposing a support surface, the distal end of the threaded stud threaded into the orifice of the hull driving the sealing surface of the shoulder to engage the seal to prevent corrosion of the threaded orifice;
- a helicopter ground attachment including a washer about the proximal end of the stud and seated on the support surface of the shoulder and a conductor extending from the washer; and
- a threaded nut about the proximal end of the stud engaging the washer.

20. A corrosion resistant connection system comprising:
- an underwater hull structure;
- a threaded orifice in the hull structure;
- a seal about the threaded orifice;
- a threaded stud including a distal end, a proximal end, and an intermediate shoulder defining a sealing surface opposing a support surface, the distal end of the threaded stud threaded into the orifice of the hull driving the sealing surface of the shoulder to engage the seal to prevent corrosion of the threaded orifice;
- a cathodic anode about the proximal end of the threaded stud seated on the support surface of the shoulder; and
- a threaded nut about the proximal end of the stud engaging the anode.

21. A corrosion resistant connection system comprising:
- a base structure;
- a threaded orifice in the base structure;

a threaded stud including a distal end, a proximal end, an intermediate shoulder defining a sealing surface opposing a support surface, and a channel in the sealing surface of the intermediate shoulder;

a seal disposed in the channel;

the distal end of the threaded stud threaded into the orifice of the base structure driving the seal to engage the base structure to prevent corrosion of the threaded orifice;

a terminal seated on the support surface of the shoulder; and a fastener about the proximal end of the stud engaging the terminal.

22. A corrosion resistant connection system comprising:

a base structure;

a first fastener including a shoulder defining a sealing surface opposing a support surface;

a seal between the sealing surface of the fastener shoulder and the base structure; and a terminal on the support surface of the fastener removable from the fastener without disturbing the seal between the sealing surface of the fastener shoulder and the base structure.

23. The system of claim 22 in which the first fastener includes a proximal stud extending from the support surface of the shoulder.

24. The system of claim 23 in which the terminal is disposed about the proximal stud.

25. The system of claim 24 further including a second fastener on the proximal stud engaging the terminal.

26. The system of claim 22 in which the first fastener includes a distal stud extending from the sealing surface of the shoulder.

27. The system of claim 26 in which the distal stud is received in the base structure.

28. The system of claim 27 further including an insert in the base structure receiving the distal end of the stud.

29. The system of claim 28 in which the insert is made of stainless steel.

30. The system of claim 22 further including a protective surface treatment between the base structure and the sealing surface of the first fastener shoulder.

31. The system of claim 22 further including a channel in the base structure receiving the seal therein.

32. The system of claim 22 further including a channel in the sealing surface of the shoulder receiving the seal therein.

33. The system of claim 22 in which the base structure is the hull of an undersea device.

34. The system of claim 33 in which the undersea device is selected from the group consisting of unmanned undersea vehicles, mine sweeping equipment, mine neutralization equipment, a sonar device, mine hunting equipment, torpedoes, submarines, and undersea structures.

35. The system of claim 22 in which the terminal is a helicopter ground attachment including a washer seated on the support surface of the shoulder and a conductor extending from the washer.

36. The system of claim 22 in which the terminal is an anode.

37. The system of claim 36 in which the anode is a zinc slug seated on the support surface of the shoulder.

38. The system of claim 22 in which the seal is an elastomeric O-ring.

39. The system of claim 38 in which the O-ring is made of rubber.

40. The system of claim 22 in which the first fastener is made of stainless steel.

41. The system of claim 22 in which the support surface of the shoulder includes a peripheral step down portion.

42. The system of claim 22 in which the periphery of the shoulder includes opposing flats engageable with a wrench.

43. A corrosion resistant connection system comprising:

a seal;

a stud including a distal end, a proximal end, and an intermediate shoulder defining a sealing surface opposing a support surface, the distal end of the stud configured to be received in a base structure driving the sealing surface of the shoulder to engage the seal and the base structure;

a terminal seated on the support surface of the shoulder; and a fastener engaging the terminal.

44. The system of claim 43 in which the distal and proximal ends of the stud are threaded.

45. The system of claim 43 in which the terminal is disposed about the proximal end of the stud.

46. The system of claim 43 in which the fastener is disposed about the proximal end of the stud.

47. A corrosion resistant connection system comprising:

a base structure;

a fastener including:

a shoulder defining a sealing surface opposing a support surface, a proximal stud extending from the support surface, and a distal stud extending from the sealing surface;

a seal between the sealing surface of the fastener shoulder and the base structure; and a terminal about the proximal stud and disposed on the support surface of the fastener and removable from the fastener without disturbing the seal between the sealing surface of the fastener shoulder and the base structure.

* * * * *